US005378755A

United States Patent [19]

Krishnan et al.

[11] Patent Number: 5,378,755

[45] Date of Patent: Jan. 3, 1995

[54] BINDING AGENT

[75] Inventors: Venkataram Krishnan, Cary; Amy G. Hammonds, Raleigh, both of N.C.

[73] Assignee: Reichhold Chemicals, Inc., Durham, N.C.

[21] Appl. No.: 113,592

[22] Filed: Aug. 27, 1993

[51] Int. Cl.[6] ..... C08L 31/06; C08L 39/00

[52] U.S. Cl. ..... 524/555; 524/558; 524/559; 524/560

[58] Field of Search ..... 524/559, 558, 560, 555

[56] References Cited

U.S. PATENT DOCUMENTS

| | | | |
|---|---|---|---|
| 2,939,855 | 6/1960 | Bartl et al. . | |
| 3,223,663 | 12/1965 | Altobelli et al. . | |
| 3,472,808 | 10/1968 | Isgur et al. . | |
| 3,505,156 | 4/1970 | Handscomb et al. | 524/559 |
| 3,650,664 | 4/1972 | DeGraff et al. . | |
| 3,662,532 | 11/1971 | Kolb et al. . | |
| 3,878,151 | 4/1975 | Dachs et al. . | |
| 3,903,035 | 9/1975 | Affeldt et al. . | |
| 4,199,490 | 4/1980 | Kamiya et al. . | |
| 4,237,249 | 12/1980 | Balzer et al. . | |
| 4,309,179 | 1/1982 | Heuser et al. . | |
| 4,331,572 | 5/1982 | Tomasi et al. . | |
| 4,381,365 | 4/1983 | Mishiba et al. . | |
| 4,480,078 | 10/1984 | Gujarathi . | |
| 4,595,617 | 6/1986 | Bogdany . | |
| 4,808,459 | 2/1989 | Smith et al. . | |
| 4,836,828 | 6/1989 | Hussamy . | |
| 4,876,293 | 10/1989 | Durney et al. | 524/559 |
| 5,093,449 | 3/1992 | Durney et al. . | |
| 5,102,424 | 4/1992 | Karsunky et al. . | |

FOREIGN PATENT DOCUMENTS

| | | |
|---|---|---|
| 790070 | 2/1958 | United Kingdom . |
| 1122848 | 8/1968 | United Kingdom . |

*Primary Examiner*—Joseph L. Schofer
*Assistant Examiner*—Jeffrey T. Smith
*Attorney, Agent, or Firm*—Bell Seltzer Park & Gibson

[57] ABSTRACT

The present invention provides a textile print paste binding agent being a polymer comprising a non-aromatic unsaturated mono- or dicarboxylic ester monomer and an aliphatic conjugated diene monomer. An unsaturated mono- or dicarboxylic acid and half esters of the dicarboxylic acid also can be included. In one embodiment, the present invention provides a process of printing a textile substrate comprising applying to a surface of the textile substrate a textile print paste comprising a tinctorial amount of a dyestuff or pigment and a binding agent being a polymer comprising a non-aromatic unsaturated mono- or dicarboxylic ester monomer and an aliphatic conjugated diene and heating the textile substrate to fix the dyestuff or pigment.

35 Claims, No Drawings

BINDING AGENT

FIELD AND BACKGROUND OF THE INVENTION

This invention relates to a binding agent useful for coloring textile substrates such as upholstery fabric, apparel/garments, towels, sheets, drapery, etc., and its method of use.

It is known that various textile substrates can be colored (e.g., printed or pad dyed) with aqueous print pastes and dyebaths comprising pigments, dyestuffs, binding agents, thickeners and other additives. The binding agent is typically utilized to provide improved crockfastness and wash fastness properties, and resistance in some instances to degradation due to UV exposure.

The binding agent is also required to bind the pigments and dyes to the textile substrate. The binding agents are typically polymeric dispersions or emulsions which undergo crosslinking under the conditions used to fix the dye or pigment. An exemplary binding agent system is one based on self-crosslinking acrylic copolymers containing N-methyol acrylamide or N-methyol methacrylamide. For example, U.S. Pat. No. 4,309,179 to Heuser et al. proposes a binding agent comprising an acrylic resin terpolymer containing 30 to 55 percent by weight styrene, 20 to 35 percent by weight acrylic acid or methacrylic acid, and 15 to 40 percent by weight of N-methylol acrylamide or N-methylol methacrylamide; a water soluble melamineformaldehyde aminoplast; and, an elastomeric latex. See, also for example, U.S. Pat. Nos. 3,878,151 to Dachs et al. and 4,331,752 Tomasi et al.

Binding agents can also be based on butadiene, styrene, and nitrile monomers and copolymers thereof, with each other and other copolymerizable monomers. For example, U.S. Pat. No. 3,223,663 to Altobelli et al. proposes a binding agent system based on a carboxylated elastomeric polymer including 1 to 5 percent acrylic acid, methacrylic acid or itaconic acid.

The binding agent should be compatible with the conventional components of the textile print paste and should not adversely effect the fastness of the print or the dye yield thereof. In the case of print pastes prepared using a binding agent derived from acrylonitrile such as a butadiene/acrylonitrile copolymer, desirable wash fastness and crockfastness properties can be obtained but exposure to UV irradiation can cause significant yellowing. Binding agents derived from acrylic polymers tend to be resistant to UV irradiation but have somewhat inferior crockfastness properties as compared to binding agents derived from nitrile-based polymers.

It is therefore an object of the present invention to provide a textile coloring agent or medium and binding agent thereof that contributes to desirable crockfastness and washfastness properties and is resistant to yellowing and degradation on exposure to UV light.

SUMMARY OF THE INVENTION

To this end, the present invention provides a binding agent for use in coloring textile substrates that has comparable fastness properties such as washfastness and crockfastness, and is resistant to yellowing on exposure to UV radiation and on thermal aging. The binding agent is a polymer comprising a non-aromatic unsaturated mono- or dicarboxylic ester monomer (e.g., methyl methacrylate) and an aliphatic conjugated diene monomer (e.g., 1,3-butadiene). The polymer can also include an unsaturated mono- or dicarboxylic acid monomer or monomer based on the half ester of the unsaturated dicarboxylic acid. The polymer can include crosslinking agents and other additional monomers to impart specific properties to the binding agent.

In one embodiment, the present invention provides a textile coloring agent or medium (e.g., print paste or dyebath) being (a) a binding agent comprising a non-aromatic unsaturated mono- or dicarboxylic ester monomer and an aliphatic conjugated diene, and (b) a tinctorial amount of a dyestuff or pigment.

In another embodiment, the present invention provides a process of coloring a textile substrate comprising applying a coloring agent, the coloring agent being a polymer comprising a non-aromatic unsaturated mono- or dicarboxylic ester monomer and an aliphatic conjugated diene, and a tinctorial amount of a dyestuff or pigment, and drying (e.g., heating) the substrate to fix or bind the dyestuff or pigment.

DETAILED DESCRIPTION OF THE INVENTION

As summarized above, the present invention relates to a binding agent for a textile coloring agent or medium (e.g., print paste or dyebath). The binding agent comprises a polymer having two basic components, namely a non-aromatic unsaturated mono- or dicarboxylic ester monomer and an aliphatic conjugated diene. The binding agent includes a tinctorial amount of a dyestuff or pigment. The coloring agent is applied to a textile substrate. The binding agent can include an unsaturated mono- or dicarboxylic acid monomer or a monomer based on the half ester of the dicarboxylic acid. The polymer can include crosslinking agents and other additional monomers to impart specific properties to the binding agent.

For purposes of this invention, the term "textile substrate" relates to a fiber, web, yarn, thread, sliver, woven fabric, knitted fabric, non-woven fabric, upholstery fabric, tufted carpet, pile carpet, etc. formed from natural fibers (e.g., cotton and wool) and synthetic fibers (e.g., polyesters and polyamides) and blends thereof. A particularly suitable textile substrate is a woven or knitted fabric.

Any organic or inorganic dye or pigment that is commonly used for textile printing or pad dyeing can be used. Exemplary dyestuffs include cationic dyes, acid dyes, direct dyes, solvent dyes, disperse dyes, fiber reactive dyes, vat dyes and azoic dyes. Exemplary pigments include phthalocyanine blue, phthalocyanine green, azo reds, benzidine yellow, carbon black, iron oxide, and the like. The pigments and dyestuffs should be dispersible in the coloring agent and should not affect the homogeneity and stability of the coloring agent. Lower color concentrations can be obtained by reducing the amount of dyestuff or pigment in the coloring agent or by diluting with conventional clear (thickener) or unpigmented printing vehicles. The tinctorial amount of the dyestuff or pigment based on the total weight of the coloring agent is typically about 0.1 to 30 percent by weight, and preferably about 0.5 to 20 percent by weight.

The coloring agent can also includes a thickener. The thickener is typically utilized to make up a vehicle for printing, and must impart the proper flow, viscosity and rheological characteristics to the print paste. The thickener is typically used as a 2 to 3 percent concentrate known as a "clear", the remainder, to a large extent being comprised of water. It is generally known to utilize an alkali neutralized thickened concentrate comprising polymers or copolymers of carboxylic acids (e.g., acrylic acid), an organic solvent, and a nonionic or anionic surfactant (e.g., condensation products of alkene oxides or sodium lauryl sulfate). Typically, about 40 to 95 percent of "clear" by weight of coloring agent is added.

Suitable non-aromatic unsaturated monocarboxylic ester monomers are acrylates and methacrylates. The acrylates and methacrylates may include functional groups such as amino groups, hydroxy groups, epoxy groups and the like. Exemplary acrylates and methacrylates include methyl acrylate, methyl methacrylate, ethyl acrylate, ethyl methacrylate, butyl acrylate, butyl methacrylate, 2-ethylhexyl acrylate, glycidyl acrylate, glycidyl methacrylate, hydroxyethyl acrylate, hydroxyethyl methacrylate, hydroxypropyl acrylate, hydroxypropyl methacrylate, hydroxybutyl acrylate, hydroxybutyl methacrylate, 3-chloro-2-hydroxybutyl methacrylate and the like. Exemplary amino-functional acrylates include t-butyl amino methyl. methacrylate and dimethylamino ethyl methacrylate. Suitable non-aromatic dicarboxylic ester monomers are alkyl and dialkyl fumarates, itaconates and maleates, having one to eight carbons, with or without functional groups. Specific monomers include diethyl and dimethyl fumarates, itaconates and maleates. Other suitable non-aromatic dicarboxylic ester monomers include di(ethylene glycol) maleate, di(ethylene glycol) itaconate, bis(2-hydroxyethyl) maleate, 2-hydroxyethyl methyl fumarate, and the like.

The esters of mono and dicarboxylic acid monomers may be blended or copolymerized with each other. For example, when the desired polymer includes an ester of a dicarboxylic acid monomer, it is preferable to form the polymer by copolymerizing the dicarboxylic ester monomer with a monocarboxylic ester monomer (e.g. methyl methacrylate). Graft polymerization can also be used.

The non-aromatic unsaturated mono- or dicarboxylic ester monomer is used in an amount, based on total weight of the starting monomers, from about 10 to 90 percent by weight, preferably from about 30 to 80 percent by weight, and most preferably from about 30 to 55 percent by weight. A particularly preferred non-aromatic unsaturated monocarboxylic ester monomer is methyl methacrylate.

Suitable aliphatic conjugated dienes are $C_4$ to $C_9$ dienes and include, for example, butadiene monomers such as 1,3-butadiene, 2-methyl-l,3-butadiene, 2 chloro-1,3-butadiene and the like. Blends or copolymers of the diene monomers can also be used. The aliphatic conjugated diene is used in an amount of, based on total weight of the starting monomers, from about 10 to 90 percent by weight, preferably from about 20 to 80 percent by weight, and most preferably from about 45 to 70 percent by weight. A particularly preferred aliphatic conjugated diene is 1,3-butadiene.

Suitable unsaturated mono- or dicarboxylic acid monomers are acrylic acid, methacrylic acid, itaconic acid, fumaric acid, and maleic acid. Suitable monomers based on the half esters of the unsaturated dicarboxylic acids include monoesters of maleic or fumaric acid having the formula ROOC—CH=CH—COOH wherein R is a $C_1$ to $C_{12}$ alkyl group for example, monomethyl maleate, monobutyl maleate and monooctyl maleate. Half esters of monoesters of itaconic acid having $C_1$ to $C_{12}$ alkyl groups such as monomethyl itaconate can also be used. Blends or copolymers of the unsaturated mono- or dicarboxylic acid monomers or monomers based on half esters of the unsaturated dicarboxylic acid can also be used.

The unsaturated mono- or dicarboxylic acid monomer based on the half ester of the unsaturated dicarboxylic acid is used in an amount of, based on total weight of the starting monomers, from about 0.1 to 20 percent by weight, preferably from about 0.3 to 10 percent by weight, and most preferably from about 0.5 to 5 percent by weight. A particularly preferred unsaturated monocarboxylic acid monomer is acrylic acid.

The polymer can include crosslinking agents and additives to improve various physical and mechanical properties of the polymer, the selection of which will be readily apparent to one skilled in the art. Exemplary crosslinking agents include vinylic compounds (e.g., divinyl benzene); allyllic compounds (e.g., allyl methacrylate, diallyl maleate); multifunctional acrylates (e.g., di, tri and tetra (meth)acrylates); self-crosslinking monomers such as N-methylol acrylamide, N-methylol methacrylamide and $C_1$–$C_4$ ethers of these monomers respectively (e.g., N-(isobutoxy methyl) acrylamide), acrylamido glycolic acid and its esters, and alkylacrylamido glycolate alkyl ethers (e.g., methylacrylamido glycolate methyl ether). The crosslinking agents can be included in amounts of up to about 7 percent by weight, and preferably about 0.05 to 5 percent by weight. Additional monomers can be included to improve specific properties such as solvent resistance (e.g.: nitrile containing monomers such as acrylonitrile and methacrylonitrile), adhesion and strength (e.g., use of acrylamide or methacrylamide).

Other additives include other natural and synthetic binders, fixing agents, surface-active compounds, wetting agents, plasticizers (e.g., diisodecyl phthalate), softeners, foam-inhibiting agents, other crosslinking agents (e.g., melamine formaldehyde resin), flame retardants, catalysts (e.g., diammonium phosphate or ammonium sulfate), dispersing agents, antimigrants (e.g., water-soluble anionic polyacrylamides having a high molecular weight), levelling agents, etc., the selection of which will be readily apparent to one skilled in the art.

Conventional pad dyeing or printing techniques may be employed to apply color to a textile substrate, the selection of which is within the skill of one in the art. A typical pad dyeing composition is as follows:

Dyestuff 5–10%
Binding Agent 5–15%
Sodium Alginate (Antimigrant) 2.5%
Nonionic Surfactant (Wetting Agent) 0.25–0.5%
Diammonium Phosphate (Catalyst) 0.1–0.25%
Water 60–90%

A typical print paste composition is as follows:

Pigment 10–20%
Binding Agent 10–20%
Clear 60–80%

The dyed or printed textile substrate is then dried at a temperature sufficient to fix the dyestuff or pigment on the textile substrate.

The present invention and its advantages over the prior art will be more fully understood and appreciated from the illustrative examples which follow. It is to be understood that the examples are for the purpose of illustration and are not intended as being limited upon the scope of the invention. A person skilled in the applicable arts will appreciate from these examples that this invention can be embodied in many different forms other than as is specifically disclosed.

EXAMPLES

Example 1

900 g of demineralized water is mixed with 1 g ethylene diamine tetraacetic acid (EDTA), 10 g sodium dicyclohexyl sulfoscuccinate, 3 g dodecyl diphenyl oxide disulfonate, and 4 g of ammonium persulfate catalyst, in a 1-gallon reactor. To this is added a mixture of 200 g methyl methacrylate, and 160 g 1,3-butadiene. The mixture is stirred and heated to 180° F. and maintained at the temperature for the rest of the reaction. After maintaining the temperature of 180° F. for 30 minutes, a mixture of 660 g methyl methacrylate, 940 g 1,3-butadiene and 4 g of t-dodecyl mercaptan is fed continuously into the reactor over a period of 5 hours. At the same time, a mixture of 4 g sodium dicyclohexyl sulfosuccinate surfactant, 500 g of demineralized water and 40 g of acrylic acid is fed continuously for 4 hours into the reactor as is a mixture of 8 g ammonium persulfate and 500 g demineralized water over a period of 5½ hours.

The reaction is carried to about 98 percent conversion and cooled. The pH is adjusted to 7.0 to 8.5 with a base such as ammonia and then steam stripped to achieve the desired solid content (typically greater than 50 percent, often greater than 55 percent and sometimes greater than 60 percent). The polymer comprises 43 percent methyl methacrylate, 55 percent 1,3-butadiene and 2 percent acrylic acid.

Examples 2–12

In order to demonstrate the effectiveness of other binding agent compositions, Example 1 is repeated except various non-aromatic mono- or dicarboxylic ester monomers and/or mono- or dicarboxylic acid monomers and half esters thereof are used. It is recognized that minor variations of Example 1 may be needed in order to utilize specific monomers. These variations will be within the skill of one in the art.

Example 2

Example 1 is repeated except the binding agent composition comprises 57 percent methyl methacrylate, 33 percent 1,3-butadiene, 5 percent butyl acrylate, 3 percent acrylic acid, and 2 percent itaconic acid.

Example 3

Example 1 is repeated except the binding agent composition comprises 52 percent methyl methacrylate, 33 percent 1,3-butadiene, 5 percent butyl acrylate, 5 percent ethyl acrylate, 2 percent itaconic acid and 3 percent acrylic acid.

Example 4

Example 1 is repeated except the binding agent composition comprises 48 percent methyl methacrylate, 45 percent 1,3-butadiene, 5 percent butyl acrylate and 2 percent monomethyl maleate.

Example 5

Example 1 is repeated except the binding agent composition comprises 48 percent methyl methacrylate and 50 percent 1,3-butadiene and 2 percent monomethyl maleate.

Example 6

Example 1 is repeated except the binding agent composition comprises 28 percent methyl methacrylate, 50 percent 1,3-butadiene, 20 percent butyl acrylate and 2 percent acrylic acid.

Example 7

Example 1 is repeated except the binding agent composition comprises 65 percent methyl methacrylate, 33 percent 1,3-butadiene and 2 percent acrylic acid.

Example 8

Example 1 is repeated except the binding agent composition comprises 38 percent methyl methacrylate, 60 percent 1,3-butadiene and 2 percent acrylic acid.

Example 9

Example 1 is repeated except the binding agent composition includes an antioxidant and comprises 43 percent methyl methacrylate, 55 percent 1,3-butadiene, 2 percent acrylic acid and 0.2 percent 4,4'-butylidene bis(6-tert butyl m-cresol).

Example 10

Example 1 is repeated except the binding agent composition comprises 65 percent methyl methacrylate, 33 percent 1,3-butadiene and 2 percent N-methylol acrylamide.

EXAMPLE 11

Example 1 is repeated except the binding agent composition comprises 38 percent methyl methacrylate, 58 percent 1,3 -butadiene, 2 percent acrylic acid and 2 percent monomethyl itaconate.

Example 12

Example 1 is repeated except the binding agent composition comprises 36 percent methyl methacrylate, 60 percent 1,3-butadiene, 2 percent acrylic acid, 1.2 percent N-methyol acrylamide, 0.8 percent acrylamide, and 0.2 percent 4,4'-butylidene bis(6-tert butyl m-cresol) antioxidant.

In order to demonstrate the desirable fastness properties and resistance to yellowing, the binding agent compositions of Examples 1, 8, 9, 11 and 12 in the form of a latex emulsion are printed on a 65/35 polyester/cotton blend woven fabric and on a 100% cotton woven fabric. The print paste comprised:

15 parts pigment
15 parts binding agent
70 parts clear

Crockfastness is measured using AATCC Test Method 8-1988 and 116-1988. Wash fastness is measured using AATCC Test Method 61-1989. Color value is measured using a Macbeth Densitometer available from Macbeth Inc., Newburg N.Y. Yellowing index measures the tendency for the polymer to yellow on heat and light aging. Using an internally developed method, the Yellowing Index is determined by mixing 50 percent of the latex emulsion with 50 percent water and padding this mixture onto a 50/50 polyester/cotton woven fabric and allowing to air dry. The fabric is then placed in an oven for 3 minutes at 325° F. to cure. A piece of this dried and cured fabric is used as a reference. The remainder of the coated fabric is then placed in the oven for extended periods of time up to 30 minutes. The resulting fabrics are analyzed for yellowing using a spectrophotometer which can determine L*a*b*, yellow index and white index. These values are compared to the reference and the degree of yellowness recorded. Effect of UV exposure on yellowing is determined similarly. The fabric is coated and cured in the same manner as for the heat aging experiment, and a small piece is then exposed to UV radiation in a QUV tester for 40 hours. Yellow Index of the exposed fabric is then determined as before.

The results are summarized in Tables 1 and 2 for the polyester/cotton blend woven fabric and for the cotton woven fabric, respectively. An acrylic and a nitrile binding agent are included for comparison.

TABLE 1

| | (Poly/Cotton) | | | | | | |
|---|---|---|---|---|---|---|---|
| Example | 1 | 8 | 9 | 11 | 12 | Nitrite | Acrylic |
| Dry Crock | 3 | 3 | 3–4 | 3 | 3-4 | 4 | 3 |
| Wet Crock | 2 | 2 | 2 | 2 | 2–3 | 3 | 2–3 |
| Wash-fastness | 3 | 2–3 | 2 | 2 | 4–5 | 4 | 5 |
| Color Value | 1.35 | 1.36 | 1.33 | 1.34 | 1.36 | 1.36 | 1.35 |
| Yellow Index/ (3 min @ 325° F.) | 27.38 | 24.48 | 5.78 | 23.20 | 5.71 | 8.62 | 5.30 |
| Yellow Index/ UV Exposure (40 hrs; 30 min. @ 325°) | 15.45 | 10.77 | 12.19 | 16.80 | 11.38 | 25.82 | 4.58 |

TABLE 2

| | (Cotton) | | | | | | |
|---|---|---|---|---|---|---|---|
| Example | 1 | 8 | 9 | 11 | 12 | Nitrile | Acrylic |
| Dry Crock | 3 | 3 | 3–4 | 3–4 | 3-4 | 4 | 3 |
| Wet Crock | 2 | 2 | 2 | 2 | 2–3 | 3 | 3 |
| Wash-fastness | 5 | 5 | 4 | 1–2 | 5 | 4–5 | 5 |
| Color Value | 1.36 | 1.34 | 1.32 | 1.34 | 1.34 | 1.34 | 1.33 |

In the specification, there have been disclosed preferred embodiments of the invention and, although specific terms are employed, they are used in a generic and descriptive sense only and not for the purpose of limitation, the scope of the invention being set forth in the following claims.

That which is claimed is:

1. In a textile coloring agent including a tinctorial amount of a dyestuff or pigment, the improvement comprising the use of a binding agent being a polymer comprising a non-aromatic unsaturated mono- or dicarboxylic ester monomer and an aliphatic conjugated diene monomer.

2. In a textile coloring agent according to claim 1 wherein the non-aromatic unsaturated mono- or dicarboxylic ester monomer is selected from the group consisting of methyl acrylate, methyl methacrylate, ethyl acrylate, ethyl methacrylate, butyl acrylate, butyl methacrylate, 2-ethylhexyl acrylate, glycidyl acrylate, glycidyl methacrylate, dimethyl fumarate, diethyl fumarate, dimethyl maleate, diethyl maleate, dimethyl itaconate, diethyl itaconate, hydroxyethyl acrylate, hydroxyethyl methacrylate, hydroxypropyl acrylate, hydroxypropyl methacrylate, hydroxybutyl acrylate, hydroxybutyl methacrylate, 3-chloro-2-hydroxybutyl methacrylate, di(ethylene glycol) maleate, di(ethylene glycol)itaconate, bis(2-hydroxyethyl) maleate, 2-hydroxyethyl methyl fumarate, t-butylamino methyl methacrylate and dimethylamino ethyl methacrylate and blends and co-monomers thereof.

3. In a textile coloring agent according to claim 1 wherein the aliphatic conjugated diene monomer is a $C_4$ to $C_9$ diene monomer.

4. In a textile coloring agent according to claim 3 wherein the $C_4$ to $C_9$ diene monomer is 1,3-butadiene.

5. In a textile coloring agent according to claim 1 wherein the binding agent comprises by weight, from about 10 to 90 percent non-aromatic unsaturated mono- or dicarboxylic ester monomer and from about 10 to 90 percent aliphatic conjugated diene monomer.

6. In a textile coloring agent according to claim 1 wherein the binding agent includes from about 0.1 to 20 percent of an unsaturated mono- or dicarboxylic acid monomer or a monomer based on a half ester of the unsaturated dicarboxylic acid.

7. In a textile coloring agent according to claim 6 wherein the unsaturated mono- or dicarboxylic acid monomer is selected from the group consisting of acrylic acid, methacrylic acid, itaconic acid, fumaric acid and maleic acid.

8. In a textile coloring agent according to claim 6 wherein the monomer based on the half ester of the unsaturated dicarboxylic acid is selected from the group consisting of monoesters of maleic or fumaric acid having the formula ROOC—CH=CH—COOH wherein R is a $C_1$ to $C_{12}$ alkyl group or monoesters of itaconic acid having $C_1$ to $C_{12}$ alkyl groups.

9. In a textile coloring agent according to claim 1 wherein the binding agent includes a crosslinking agent.

10. In a textile coloring agent according to claim 9 wherein the crosslinking agent is a nitrogen-containing monomer.

11. In a textile coloring agent according to claim 10 wherein the nitrogen-containing monomer is selected from the group consisting of N-methylol acrylamide, N-methylol methacrylamide, $C_1$–$C_4$ ethers of N-methylol acrylamide and methacrylamide, acrylamido glycolic acid, $C_1$–$C_4$ esters of acrylamido glycolic acid, and alkylacrylamido glycolate alkyl ethers.

12. In a textile coloring agent according to claim 1 wherein the binding agent includes an acrylonitrile, methacrylonitrile, acrylamide or methacrylamide.

13. In a textile coloring agent according to claim 9 wherein the amount of crosslinking agent is from about 0.05 to 5 percent.

14. A textile coloring agent comprising (a) a tinctorial amount of a dyestuff or pigment and (b) a binding agent being a polymer comprising from about 30 to 55 percent, by weight, of a non-aromatic mono- or dicarboxylic ester monomer, from about 45 to 70 percent, by weight, of an aliphatic conjugated diene monomer, and from about 0 to 20 percent, by weight, of an unsaturated mono- or dicarboxylic acid monomer or a monomer based on a half ester of an unsaturated dicarboxylic acid.

15. The textile coloring agent of claim 14 wherein the non-aromatic unsaturated mono- or dicarboxylic ester monomer is selected from the group consisting of methyl acrylate, methyl methacrylate, ethyl acrylate, ethyl methacrylate, butyl acrylate, butyl methacrylate, 2-ethylhexyl acrylate, glycidyl acrylate, glycidyl methacrylate, dimethyl fumarate, diethyl fumarate, dimethyl maleate, diethyl maleate, dimethyl itaconate, diethyl itaconate, hydroxyethyl acrylate, hydroxyethyl methacrylate, hydroxypropyl acrylate, hydroxypropyl methacrylate, hydroxybutyl acrylate, hydroxybutyl methacrylate, 3-chloro-2-hydroxybutyl methacrylate, di(ethylene glycol) maleate, di(ethylene glycol)itaconate, bis(2-hydroxyethyl) maleate, 2-hydroxyethyl methyl fumarate, t-butylamino methyl methacrylate and dimethylamino ethyl methacrylate and blends and co-monomers thereof.

16. The textile coloring agent according to claim 14 wherein the aliphatic conjugated diene monomer is a $C_4$ to $C_9$ diene monomer.

17. The textile coloring agent according to claim 16 wherein the $C_4$ to $C_9$ diene monomer is 1,3-butadiene.

18. The textile coloring agent of claim 14 wherein the binding agent comprises by weight, from about 30 to 55 percent, by weight, methyl methacrylate monomer, from about 45 to 70 percent, by weight, 1,3-butadiene monomer and from about 0 to 20 percent, by weight, of an unsaturated mono- or dicarboxylic acid monomer selected from the group consisting of acrylic acid, methacrylic acid, itaconic acid, fumaric acid and maleic acid or a monomer based on the half ester of the unsaturated dicarboxylic acid selected from the group consisting of monoesters of maleic or fumaric acid having the formula ROOC—CH=CH—COOH wherein R is a $C_1$ to $C_{12}$ alkyl group and monoesters of itaconic acid having $C_1$ to $C_{12}$ alkyl groups.

19. The textile coloring agent according to claim 14 wherein the binding agent includes a crosslinking agent.

20. The textile coloring agent according to claim 19 wherein the crosslinking agent is a nitrogen-containing monomer.

21. The textile coloring agent according to claim 20 wherein the nitrogen-containing monomer is selected from the group consisting of N-methylol acrylamide, N-methylol methacrylamide, $C_1$–$C_4$ ethers of N-methylol acrylamide and methacrylamide, acrylamido glycolic acid, $C_1$–$C_4$ esters of acrylamido glycolic acid, and alkylacrylamido glycollate alkyl ethers.

22. The textile coloring agent according to claim 14 wherein the binding agent includes an antioxidant.

23. A textile coloring agent comprising:

(a) a tinctorial amount of a dyestuff or pigment and (b) a binding agent being a polymer comprising a non-aromatic unsaturated mono- or dicarboxylic ester monomer and an aliphatic conjugated diene monomer.

24. The textile coloring agent of claim 23 wherein the non-aromatic unsaturated mono- or dicarboxylic ester monomer is selected from the group consisting of methyl acrylate, methyl methacrylate, ethyl acrylate, ethyl methacrylate, butyl acrylate, butyl methacrylate, 2-ethylhexyl acrylate, glycidyl acrylate, glycidyl methacrylate, dimethyl fumarate, diethyl fumarate, dimethyl maleate, diethyl maleate, dimethyl itaconate, diethyl itaconate, hydroxyethyl acrylate, hydroxyethyl methacrylate, hydroxypropyl acrylate, hydroxypropyl methacrylate, hydroxybutyl acrylate, hydroxybutyl methacrylate, 3-chloro-2-hydroxybutyl methacrylate, di(ethylene glycol) maleate, di(ethylene glycol)itaconate, bis(2-hydroxyethyl) maleate, 2-hydroxyethyl methyl fumarate, t-butylaminomethyl methacrylate and dimethylamino ethyl methacrylate and blends and co-monomers thereof.

25. The textile coloring agent according to claim 24 wherein the non-aromatic unsaturated mono- or dicarboxylic ester is methyl methacrylate.

26. The textile coloring agent according to claim 24 wherein the aliphatic conjugated diene monomer is a $C_4$ to $C_9$ diene monomer.

27. The textile coloring agent according to claim 26 wherein the $C_4$ to $C_9$ diene monomer is 1,3-butadiene.

28. The textile coloring agent of claim 24 wherein the binding agent comprises by weight, from about 10 to 90 percent non-aromatic unsaturated mono- or dicarboxylic ester monomer and from about 10 to 90 percent aliphatic conjugated diene monomer.

29. The textile coloring agent according to claim 24 wherein the binding agent includes from about 1 to 20 percent of an unsaturated mono- or dicarboxylic acid monomer or a monomer based on a half ester of the unsaturated dicarboxylic acid.

30. The textile coloring agent of claim 29 wherein the unsaturated mono- or dicarboxylic acid or monomers based on the half ester of the dicarboxylic acid is selected from the group consisting of monomers of acrylic acid, methacrylic acid, itaconic acid, fumaric acid and maleic acid and monoesters of maleic or fumaric acid having the formula ROOC—CH=CH—COOH wherein R is a $C_1$ to $C_{12}$ alkyl group or monoesters of itaconic acid having $C_1$ to $C_{12}$ alkyl groups.

31. The textile coloring agent according to claim 24 wherein the binding agent includes a crosslinking agent.

32. The textile coloring agent according to claim 31 wherein the crosslinking agent is a nitrogen-containing monomer.

33. The textile coloring agent according to claim 32 wherein the nitrogen-containing monomer is selected from the group consisting of N-methylol acrylamide, N-methylol methacrylamide, $C_1$–$C_4$ ethers of N-methylol acrylamide and methacrylamide, acrylamido glycolic acid, $C_{1-C4}$ esters of acrylamido glycolic acid, and alkylacrylamido glycolate alkyl ethers.

34. In a textile coloring agent according to claim 23 wherein the binding agent includes an acrylonitrile, methacrylonitrile, acrylamide or methacrylamide.

35. The textile coloring agent according to claim 23 wherein the binding agent includes an antioxidant.

* * * * *